US005924195A

United States Patent [19]

Guadagni

[11] Patent Number: 5,924,195

[45] Date of Patent: Jul. 20, 1999

[54] M113A1/A2 TO M113A3 CONVERSION

[75] Inventor: Thomas Victor Guadagni, Dublin, Calif.

[73] Assignee: United Defense, LP, Arlington, Va.

[21] Appl. No.: 08/911,691

[22] Filed: Aug. 15, 1997

[51] Int. Cl.[6] ..... B23P 15/00

[52] U.S. Cl. ..... 29/888.011; 29/888; 29/897.2

[58] Field of Search ..... 29/888, 897.2, 29/401.1, 428, 426.1, 888.011

[56] References Cited

U.S. PATENT DOCUMENTS 3,945,367 3/1976 Turner, Jr. ..... 29/401.1
5,490,314 2/1996 Riddle ..... 29/401.1
5,577,311 11/1996 Riddle ..... 29/401.1

*Primary Examiner*—I. Cuda
*Attorney, Agent, or Firm*—Douglas W. Rudy; Michael B. K. Lee; Ronald C. Kamp

[57] ABSTRACT

A method of modifying and converting an M113A1/A2 into a M113A3 with the use of the M113A3 style powerpack and the M113A1/A2 engine access hole location, which method utilizes a remote engine oil filter that allows the access hole in the bottom plate to remain unchanged from the M113A1/A2 to the M113A3, a remote engine oil filter adapter to accommodate the remote engine oil filter and a remote transmission oil drain and an engine oil adapter to allow engine oil drainage and transmission fluid service through the access hole.

5 Claims, 3 Drawing Sheets

M113A1/A2 TO M113A3 CONVERSION

BACKGROUND OF THE INVENTION

The invention relates to a method for converting an M113A1 or M113A2 vehicle into the M113A3 configuration. An M113is a military tracked vehicle built by United Defense L. P.

Prior conversions of the M113A1 or the M113A2 to the M113A3 configuration included the relocation of the engine access hole in the bottom plate of the carrier. The purpose of the access hole is to allow for draining the engine oil and replacing the engine oil filter. The hull modification was been necessary in the past to accommodate the new engine location of the newer M113A3 style powerpack. This hull modification is both time consuming and expensive.

SUMMARY OF THE INVENTION

It is an object of the invention to provide a lower cost approach to converting from an M113A1 (first model M113) or M113A2 (upgraded second model M113) vehicle into the M113A3 (further upgraded third model M113) configuration.

The new conversion method disclosed herein includes the removal and relocation of the engine oil filter and relocation of engine and transmission drain spouts and the provision of a remote oil filter.

This invention provides for a method of modifying and converting an M113A1/A2 into a M113A3 with the use of the M113A3 style powerpack and the M113A1/A2 engine access hole location. The method of conversion utilizes a remote engine oil filter that allows the access hole in the bottom plate to remain unchanged from the M113A1/A2 to the M113A3.

DESCRIPTION OF THE PREFERRED EMBODIMENTS

Figure 1:
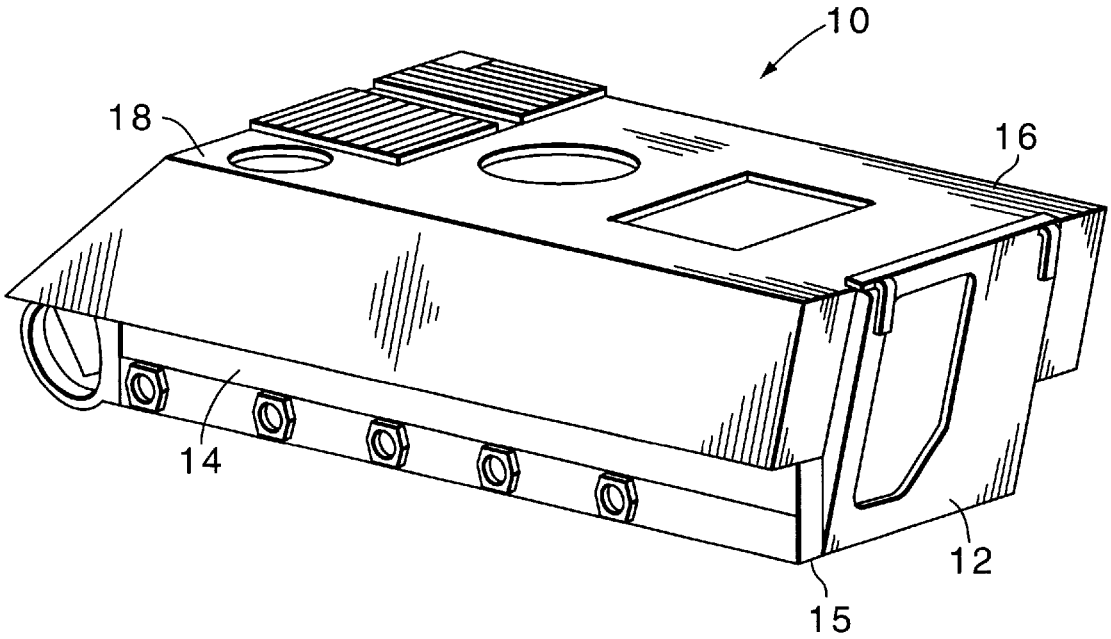
FIG. 1 is a perspective view of an M113 structure.
Figure 2:
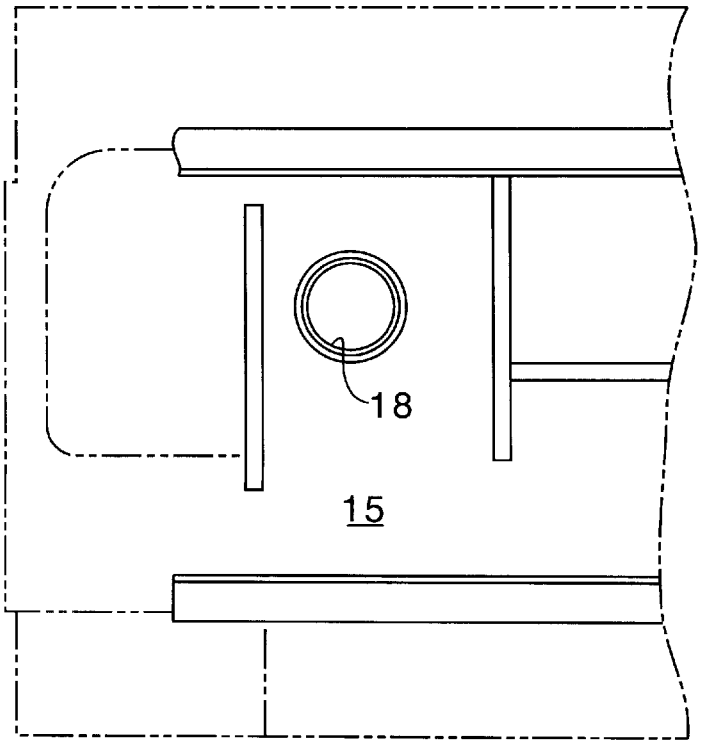
FIG. 2 is a drawing of the vehicle floor section showing the engine drain access hole of the M113.

FIG. 1 is a perspective view of an M113 structure 10, which has a rear plate 12, a top plate 16, and a lower hull 14, which has a bottom plate 15. FIG. 2 shows is a detailed view of part of the bottom plate 15, showing a drain access hole 18.

In converting the M113A1 or M113A2 to an M113A3 a 6V53 engine with a TX-100-1 transmission is removed from the M113A1 or M113A2. A 6V53-T engine (manufactured by Detroit Diesel), and an X200-4 transmission (manufactured by Allison Transmission) are placed in the M113, to make it an M113A3.

Figure 3:
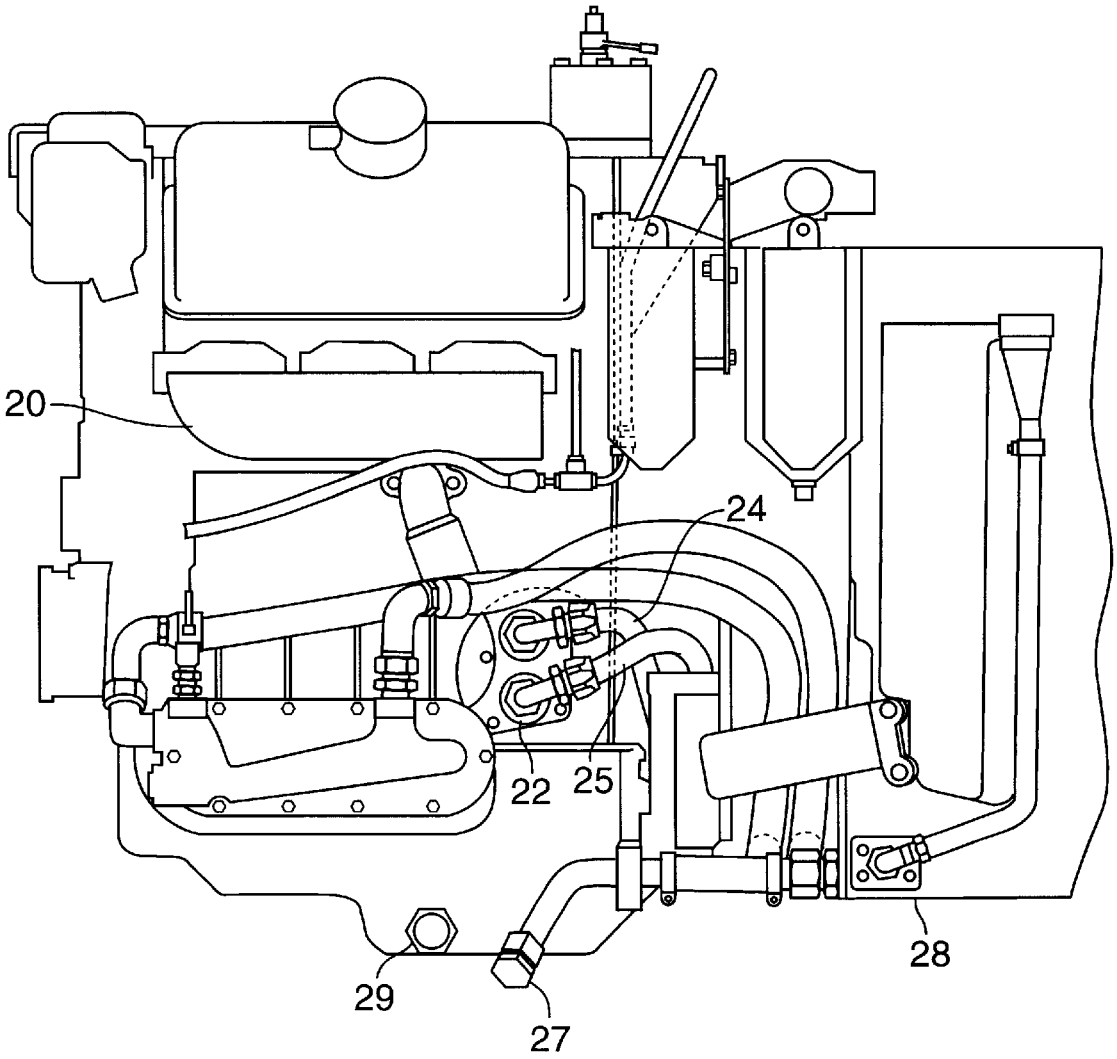
FIG. 3 is a side view of a modified M113A3 engine.
Figure 4:
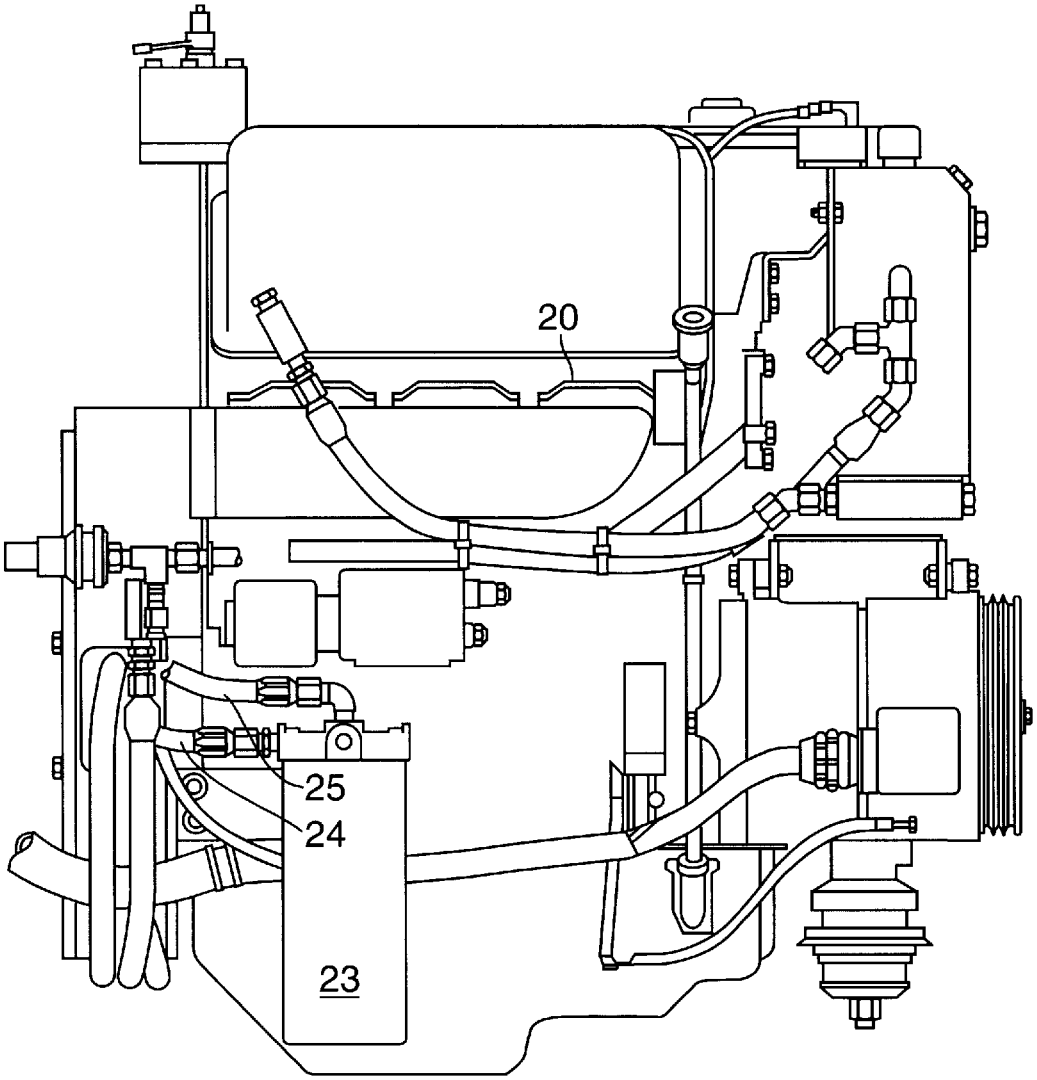
FIG. 4 is a side view of the M113A3 engine opposite from the side view shown in FIG. 3.

FIGS. 3 and 4 are opposite side views of the 6V53-T engine 20 used in an M113A. A remote oil filter adapter 22 is placed on the 6V53-T engine 20 and allows for the placement of remote engine oil filter 23 (shown in FIG. 4) adjacent to an engine access panel. A supply hose 24 and return hose 25 are connect between the remote engine oil filter 23 and the remote oil filter adapter 22. A transmission oil drain adapter 27 is fitted to the X200-4 transmission 28. An engine oil drain adapter 29 is fitted to the 6V53-T engine 20. The transmission oil drain adapter 27 and the engine oil drain adapter 29 allow oil draining through the drain access hole 18.

In the prior art, a 20×30 inch section of the bottom plate 15 around the drain access hole 18 had to be cut out to move the location of the drain access hole to a position that would accommodate a non-remote oil filter on a 6V53-T engine.

In other embodiments, other engines and transmissions may be used. Such engines would have a power of above 220 horse power, like the 6V53-T engine.

While a preferred embodiment of the modified M113A1/A2 to M113A3 vehicle conversion method has been shown and disclosed, it will be appreciated that various changes and modifications may be made therein without departing from the spirit of the invention as defined by the scope of the appended claims.

What is claimed is:

1. A method for upgrading an M113 with an engine oil access hole to an M113A3, comprising the steps of:

removing an original engine and original transmission;

installing an upgrade engine and upgrade transmission;

attaching a remote oil filter adapter to the upgrade engine;

connecting a first end of a supply hose to the remote oil filter adapter;

connecting a first end of a return hose to the remote oil filter adapter;

connecting a second end of the supply hose to a remote oil filter; and connecting a second end of the return hose to the remote oil filter.

2. The method, as recited in claim 1, further comprising the step of positioning the remote oil filter above the engine oil access hole.

3. The method, as recited in claim 2, further comprising the steps of:

attaching a remote transmission oil drain adapter to the upgrade transmission; and attaching an engine oil adapter to the upgrade engine.

4. The method, as recited in claim 3, further comprising the steps of:

positioning a drain end of the transmission drain adapter above the engine oil access hole; and positioning a drain end of the engine oil adapter above the engine oil access hole.

5. The method, as recited in claim 4, wherein the step of installing an upgrade engine and upgrade transmission, comprises the steps:

of installing a 6V53-T engine; and installing an X200-4 transmission.

* * * * *